US006509917B1

(12) United States Patent
Chwalek et al.

(10) Patent No.: US 6,509,917 B1
(45) Date of Patent: Jan. 21, 2003

(54) CONTINUOUS INK JET PRINTER WITH BINARY ELECTROSTATIC DEFLECTION

(75) Inventors: James M. Chwalek, Pittsford, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/953,610

(22) Filed: Oct. 17, 1997

(51) Int. Cl.[7] ..... B41J 2/105; B41J 2/09
(52) U.S. Cl. ..... 347/82; 347/77
(58) Field of Search ..... 347/73–78, 82

(56) References Cited

U.S. PATENT DOCUMENTS

| | | | | |
|---|---|---|---|---|
| 1,941,001 A | | 12/1933 | Hansell | |
| 3,287,734 A | | 11/1966 | Kazan | 347/75 |
| 3,373,437 A | | 3/1968 | Sweet et al. | |
| 3,416,153 A | | 12/1968 | Hertz et al. | |
| 3,709,432 A | * | 1/1973 | Robertson | 347/82 |
| 3,878,519 A | * | 4/1975 | Eaton | 347/82 |
| 3,916,421 A | | 10/1975 | Hertz | |
| 3,925,789 A | * | 12/1975 | Kashio | 347/82 |
| 3,979,756 A | | 9/1976 | Helinski et al. | |
| 4,068,241 A | * | 1/1978 | Yamada | 347/75 |
| 4,070,679 A | | 1/1978 | Fan et al. | 347/75 |
| 4,148,718 A | | 4/1979 | Fulwyler | |
| 4,230,558 A | | 10/1980 | Fulwyler | |
| 4,318,483 A | | 3/1982 | Lombardo et al. | |
| 4,346,387 A | | 8/1982 | Hertz | |
| 4,646,106 A | | 2/1987 | Howkins | |
| 5,160,939 A | | 11/1992 | Bajeux et al. | |

FOREIGN PATENT DOCUMENTS

JP 56-21866 2/1981

OTHER PUBLICATIONS

J. L. Johnson, Principles of Non Impact Printing,Palatino Press, Irvine, CA., 1986, pp. 252–255.

* cited by examiner

*Primary Examiner*—Thinh Nguyen
(74) *Attorney, Agent, or Firm*—Milton S. Sales

(57) ABSTRACT

Apparatus and process for controlling ink in a continuous ink jet printer in which a continuous stream of ink is emitted from a nozzle includes a droplet generator which causes the stream to break up into a plurality of droplets with an adjustable drop break off position having at least (1) a first drop break off position spaced from the nozzle and (2) a second drop break off position spaced from the first drop break off position. A stream deflector adjacent to the stream between the first drop break off position and the second drop break off position controls the direction of the stream between a print direction and a non-print direction. A charging apparatus is associated with the ink delivery channel to electrically charge the ink stream. The stream deflector includes at least one deflection electrode; and a deflection control circuit is adapted to apply a constant DC voltage to the deflection electrode to deflect droplets from one of the print and non-print directions to the other of the print and non-print directions.

14 Claims, 7 Drawing Sheets

CONTINUOUS INK JET PRINTER WITH BINARY ELECTROSTATIC DEFLECTION

CROSS REFERENCE TO RELATED APPLICATIONS

Reference is made to commonly assigned, co-pending U.S. patent application Ser. No. 08/955,562 filed Oct. 17, 1997 entitled CONTINUOUS INK JET PRINTER WITH ELECTROSTATIC DROP DEFLECTION in the names of J. Chwalek and C. Anagnostopoulos; Ser. No. 08/954,317 filed on Oct. 17, 1997 entitled CONTINUOUS INK JET PRINTER WITH ASYMMETRIC HEATING DROP DEFLECTION in the names of J. Chwalek, D. Jeanmaire, and C. Anagnostopoulos; Ser. No. 08/953,525 filed on Oct. 17, 1997 entitled CONTINUOUS INK JET PRINTER WITH VARIABLE CONTACT DROP DEFLECTION in the names of G. Hawkins, C. Anagnostopoulos, J. Chwalek, and D. Jeanmaire; and Ser. No. 08/954,681 filed on Oct. 17, 1997 entitled CONTINUOUS INK JET PRINTER WITH MICROMECHANICAL ACTUATOR DROP DEFLECTION in the names of J. Chwalek, G. Hawkins, and C. Anagnostopoulos. All of the above-listed applications are filed concurrently herewith.

FIELD OF THE INVENTION

This invention relates generally to the field of digitally controlled printing devices, and in particular to continuous ink jet printheads which integrate multiple nozzles on a single substrate and in which the breakup of a liquid ink stream into droplets is caused by a periodic disturbance of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 to Hansell.

U.S. Pat. No. 3,373,437, which issued to Sweet et al. in 1967, discloses an array of continuous ink jet nozzles wherein ink drops to be printed are selectively charged and deflected towards the recording medium. This technique is known as binary deflection continuous ink jet, and is used by several manufacturers, including Elmjet and Scitex.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture. This technique is used in ink jet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging tunnels, deflection plates are used to actually deflect drops.

Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. If there is no electric field present or if the drop break off point is sufficiently far from the electric field (even if a portion of the stream before drop break off is in the presence of an electric field), then charging will not occur. In the current invention, the electrostatic charging tunnels are unnecessary. Instead, the drop or drops that are desired to reach the recording medium may be selected by applying a relatively low energy pulse to the heater while a DC field may be placed on the deflection electrode that is located near the drop streams. This offers the advantage of low power consumption as well as the simplification and cost reduction of a DC field as opposed to a switchable field required in the prior art.

DISCLOSURE OF THE INVENTION

It is an object of the present invention to provide a high speed apparatus and method of page width printing utilizing a continuous ink jet method whereby drop formation and deflection may occur at high repetition.

It is another object of the present invention to provide an apparatus and method of continuous ink jet printing with drop deflection means which can be integrated with the printhead utilizing the advantages of silicon processing technology offering low cost, high volume methods of manufacture.

It is yet another object of the present invention to provide an apparatus and method for continuous ink jet printing that does not require electrostatic charging tunnels.

It is still another object of the present invention to obtain selection of drops for recording through the application of a relatively low energy pulse to the heater(s) resulting in low power consumption while utilizing a DC field for deflection.

According to one feature of the present invention, apparatus is provided for controlling ink in a continuous ink jet printer. An ink stream generator establishes a continuous flow of ink from a nozzle in a stream. A droplet generator causes the stream to break up into a plurality of droplets with an adjustable drop break off position having at least (1) a first drop break off position spaced from the nozzle and (2) a second drop break off position spaced from the first drop break off position. A stream deflector adjacent to the stream between the first drop break off position and the second drop break off position controls the direction of the stream between a print direction and a non-print direction.

According to another feature of the present invention, a process is provided for controlling ink in a continuous ink jet printer in which a continuous stream of ink is emitted from a nozzle. A continuous flow of ink in a stream is established, in which the stream breaks up into a plurality of droplets with at least (1) a first drop break off position spaced from the nozzle and (2) a second drop break off position spaced from the first drop break off position. The ink stream is deflected between the first drop break off position and the second drop break off position to thereby control the direction of the stream between a print direction and a non-print direction.

According to a preferred embodiment of the present invention, the droplet generator is a heater. The ink stream generator includes an ink delivery channel; a source of ink communicating with the ink delivery channel, wherein the ink is pressurized above atmospheric pressure; and a nozzle bore which opens into the ink delivery channel. An ink gutter is provided in the path of ink droplets traveling in only one of the print and non-print directions.

According to another feature of the preferred embodiment of the present invention, a deflection apparatus is associated with the ink delivery channel to deflect the ink stream. The stream deflector includes at least one deflection electrode; and a deflection circuit is adapted to apply a constant DC voltage to the deflection electrode to deflect droplets from one of the print and non-print directions to the other of the print and non-print directions.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2(*b*) illustrates operation of the printhead with the binary electrostatic deflection means with electrical energy supplied to the heater.

FIG. 3(*b*) shows a top view of nozzle with binary electrostatic deflection means.

FIG. 4(*b*) illustrates operation of an alternate embodiment of the printhead with the binary electrostatic deflection means with electrical energy supplied to the heater.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
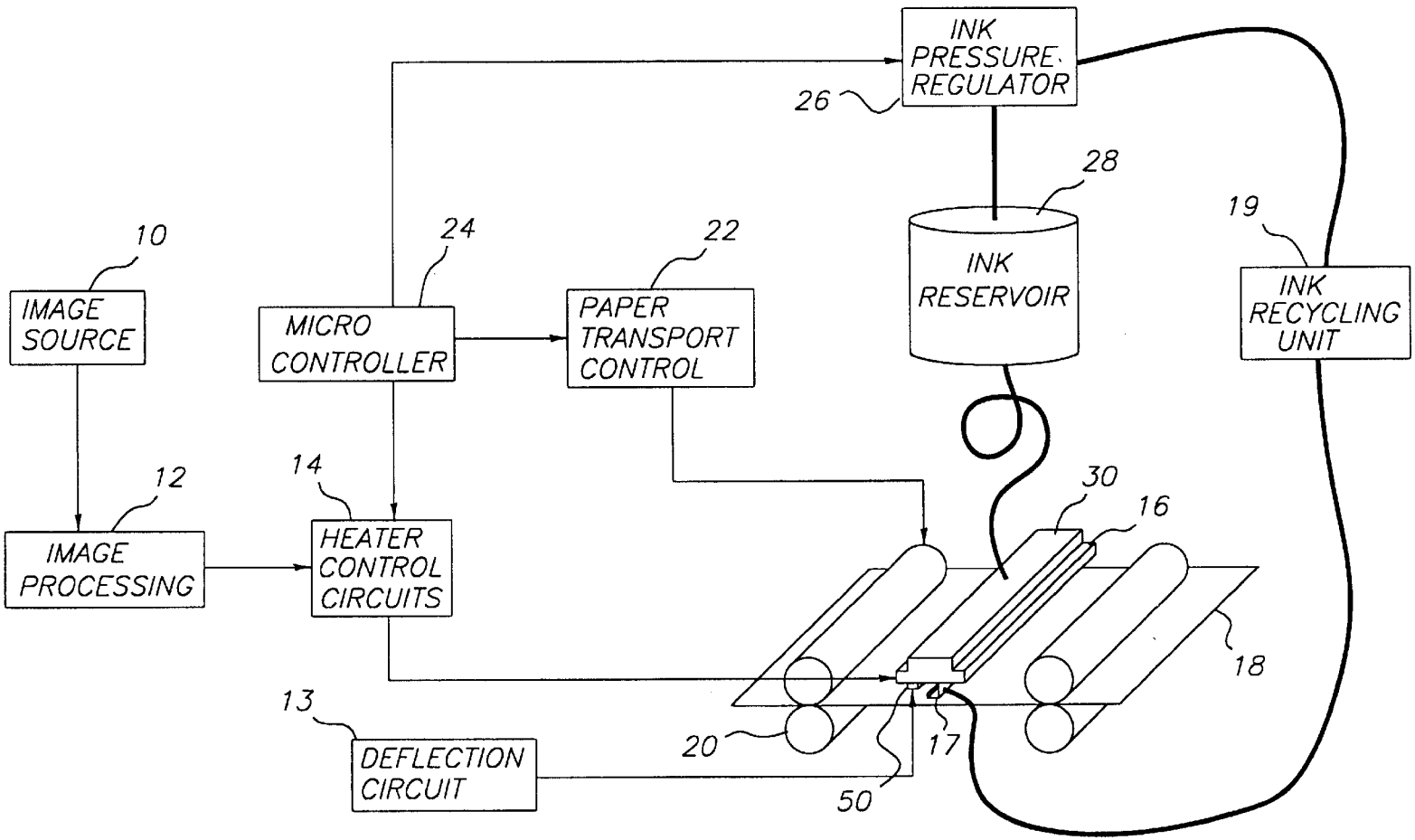
FIG. 1 shows a simplified block schematic diagram of one exemplary printing apparatus according to the present invention.

Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzles heaters 50, FIG. 2, that are part of a printhead 16. These pulses are applied at an appropriate time, and to the appropriate nozzle, so that drops formed from a continuous ink jet stream will form spots on a recording medium 18 in the appropriate position designated by the data in the image memory. In the preferred embodiment, deflection circuit 13 may be a DC voltage source.

Recording medium 18 is moved relative to printhead 16 by a recording medium transport system 20, and which is electronically controlled by a recording medium transport control system 22, which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along the orthogonal axis (the main scanning direction) in a relative raster motion.

Micro-controller 24 may also control an ink pressure regulator 26 and heater control circuits 14. Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface, where a plurality of nozzles and heaters are situated. With printhead 16 fabricated from silicon, it is possible to integrate heater control circuits 14 with the printhead.

Figure 2A:
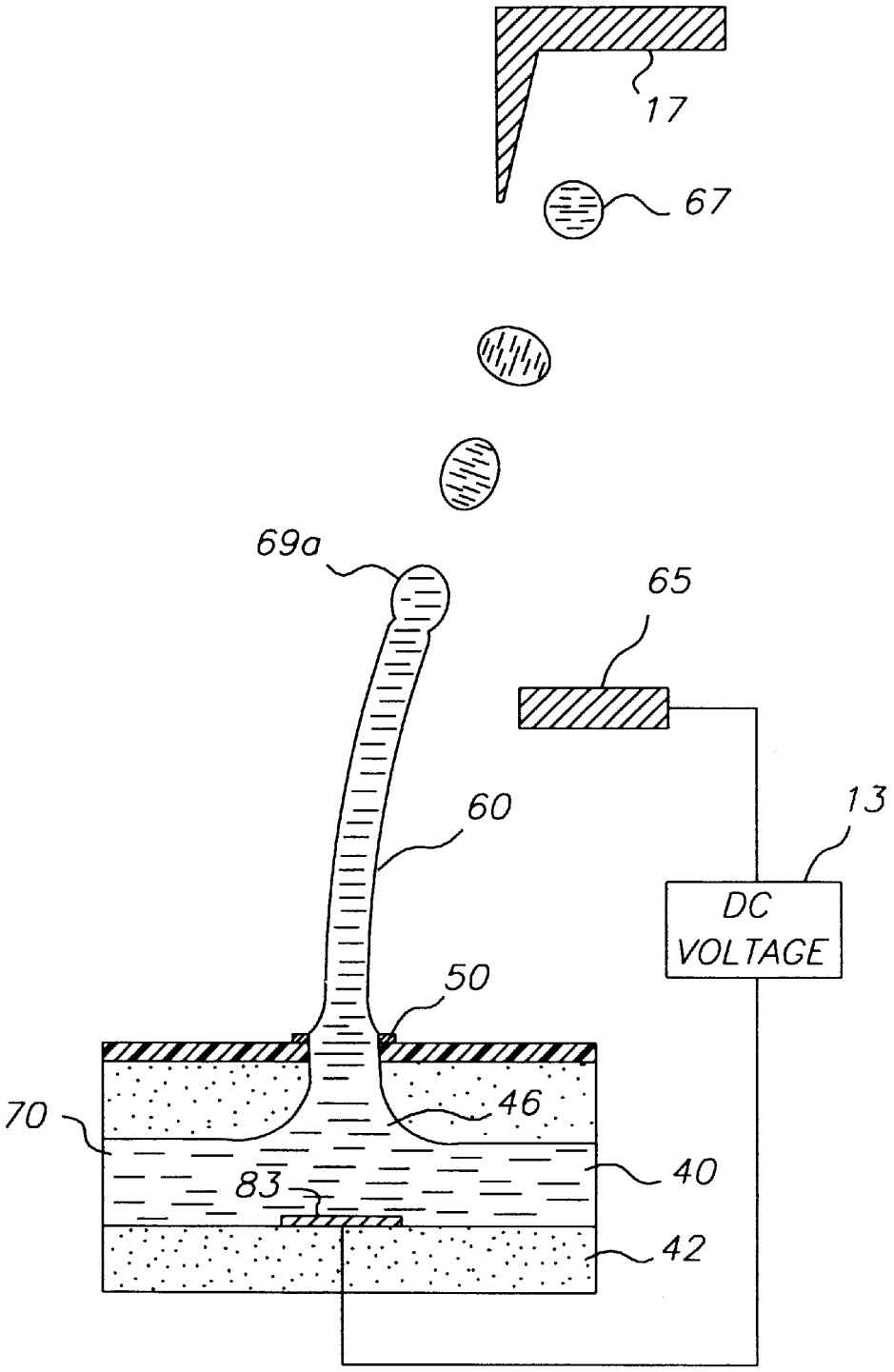
FIG. 2(*a*) illustrates operation of the printhead with the binary electrostatic deflection means without electrical energy supplied to the heater.
Figure 2B:
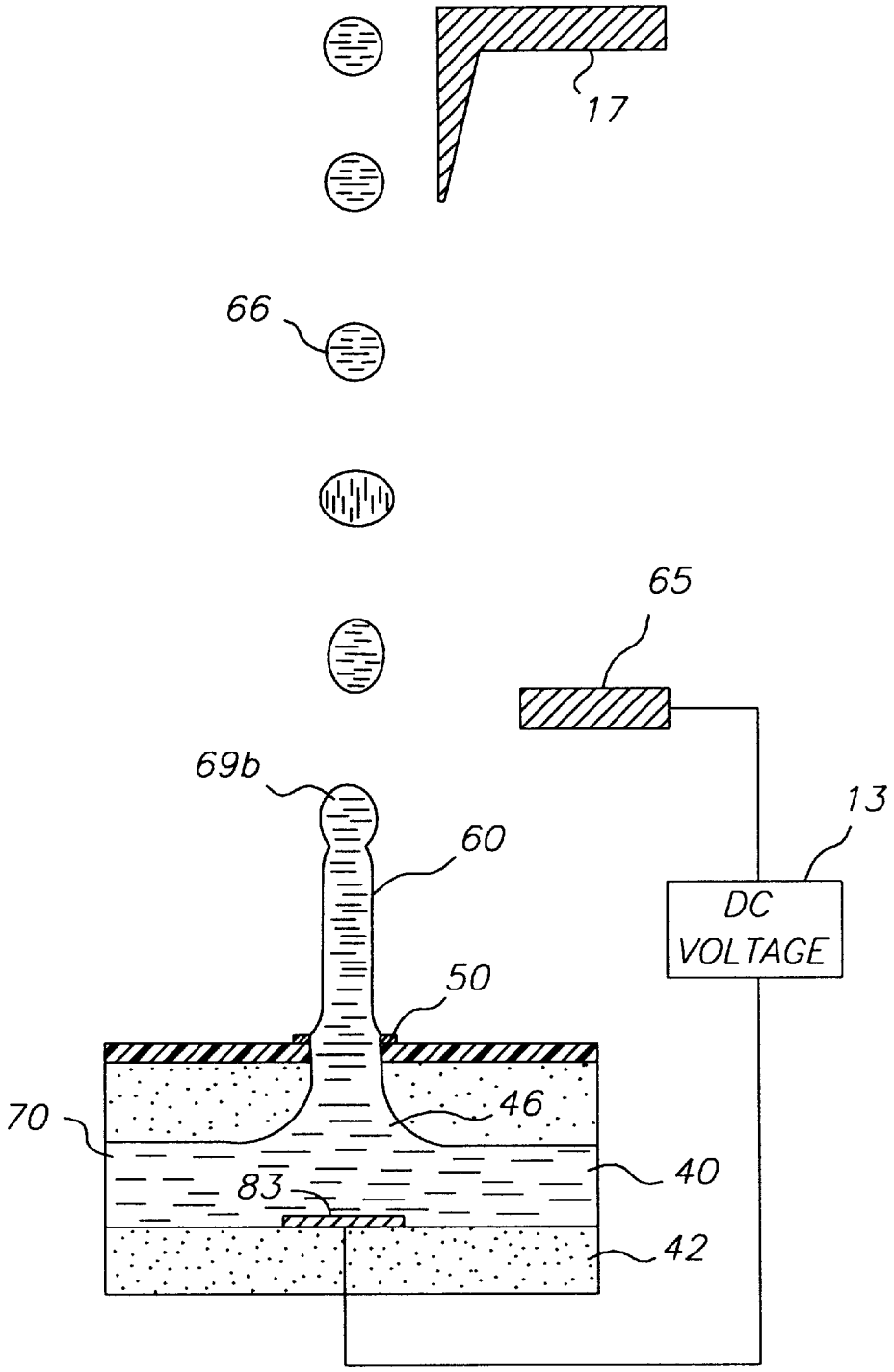

FIG. 2(*a*) is a cross-sectional view of one nozzle tip of an array of such tips that form continuous inkjet printhead 16 of FIG. 1 according to a preferred embodiment of the present invention. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Electrically conductive ink 70 in delivery channel 40 is pressurized above atmospheric pressure, and forms a stream 60. At a distance above nozzle bore 46, stream 60 breaks into a plurality of drops 66 due to heat supplied by a heater 50.

The drop breakup point or separation distance may be changed through the application of electrical energy to the heater. It can be shown (J. L. Johnson, *Principles of Non Impact Printing*, Palatino Press, Irvine, Calif., 1986, pp.252–255) that the separation distance, $L_s$ defined by the distance from the nozzle bore 46 to the drop breakup point is given approximately by $$L_s=\tau_s v_0 ln(d_0/\delta_0), \quad (1)$$

where $\tau_s$ is the separation time constant which is dependent upon the density and surface tension of the liquid in the stream, the frequency of the disturbance, and the diameter of the jet, $d_0$. $v_0$ is the velocity of the stream while the amplitude of the initial disturbance or perturbation is $\delta_0$.

In FIG. 2(*a*), there is no electrical energy supplied to the heater, and as a result, small amplitude random disturbances to stream 60 result in random drop breakup with a large separation distance. In FIG. 2(*b*), electrical energy is supplied to heater 50, resulting in a relatively large perturbation to the liquid stream 60. From Equation (1), this relatively large disturbance results in a reduced separation distance. A deflection electrode 65 is placed radially close to liquid stream 60 at a position that is above the drop break off point 69*b* for the case where electrical energy is supplied to the heater (FIG. 2(*b*)) but below the drop break off point 69*a* of the case where no electrical energy is supplied (FIG. 2(*a*)). In the case of an array of nozzles this electrode may extend laterally across all of the nozzles.

An electrode 83 is positioned in or near bore 46 in order to make an electrical contact with electrically conductive ink 70. Alternatively, electrical contact to ink 70 may be made by conductive surfaces, such as metallic surfaces, which could be used for the walls of delivery channel 40.

Deflection of the stream 60 occurs for the case where no electrical energy is supplied to the heater with a DC voltage applied to deflection electrodes 65 and ink 70 by drop deflection circuit 13 (FIG. 2(*a*)). This may occur without significant charging of drops 66. Any charging of undeflected drops 66 is inconsequential, as it is not used as the basis of drop discrimination. It is possible that stream 60 may undergo a small amount of deflection due to the proximity with deflection electrode 65. It is also possible that any charging of undeflected drops 66 may result in a small amount of deflection of these drops. Either deflection is of no consequence as long as there is enough separation between the two states to allow the ink gutter to prevent deflected drops 67 from reaching recording medium 18.

It is also recognized from consideration of Equation (1) that it is possible to change and modulate the drop break off point by changing the pressure applied to ink 70 in the delivery channel due to the resulting change in the stream velocity, $v_0$. It is also possible to change and modulate the drop break off point by changing the frequency of the electrical energy applied to the heater resulting in a change of the separation time constant, $\tau_s$.

Figure 3A:
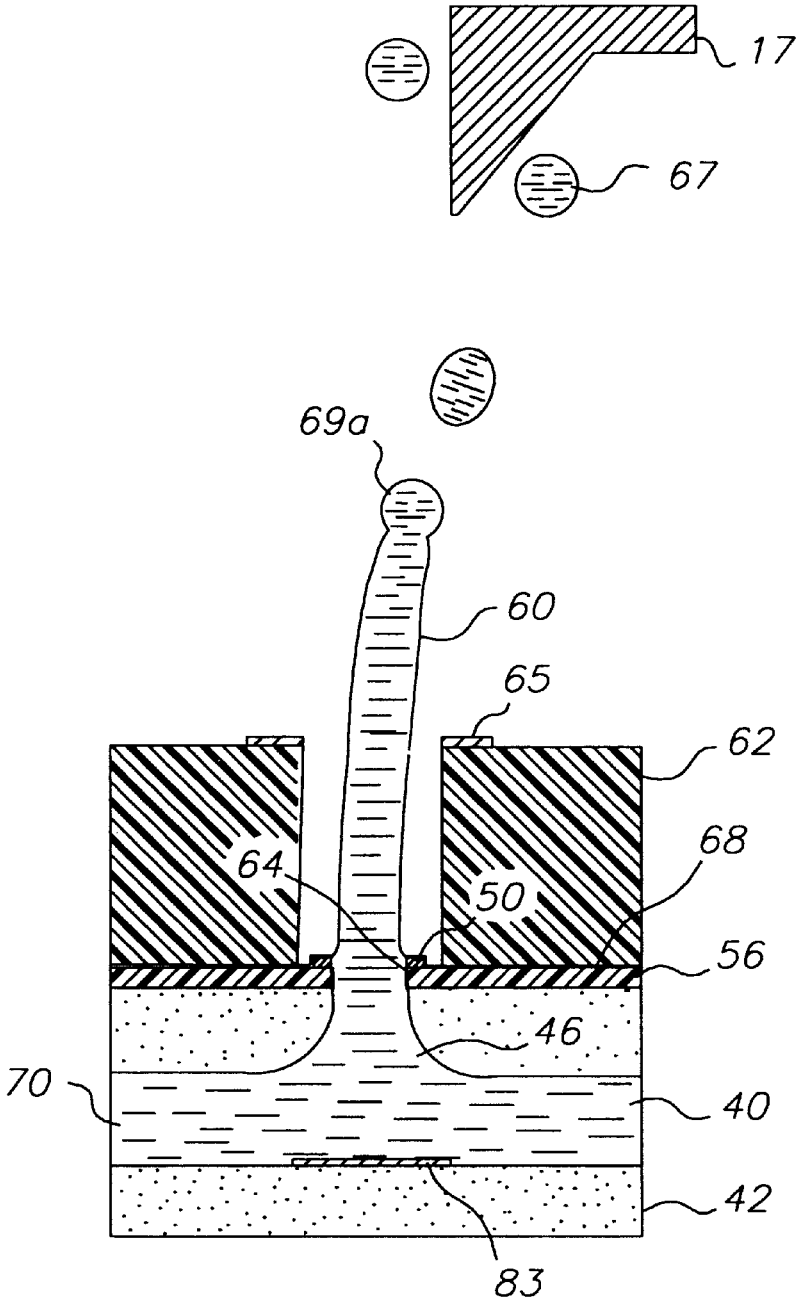
FIG. 3(*a*) shows a cross section of the nozzle with binary electrostatic deflection means.
Figure 3B:
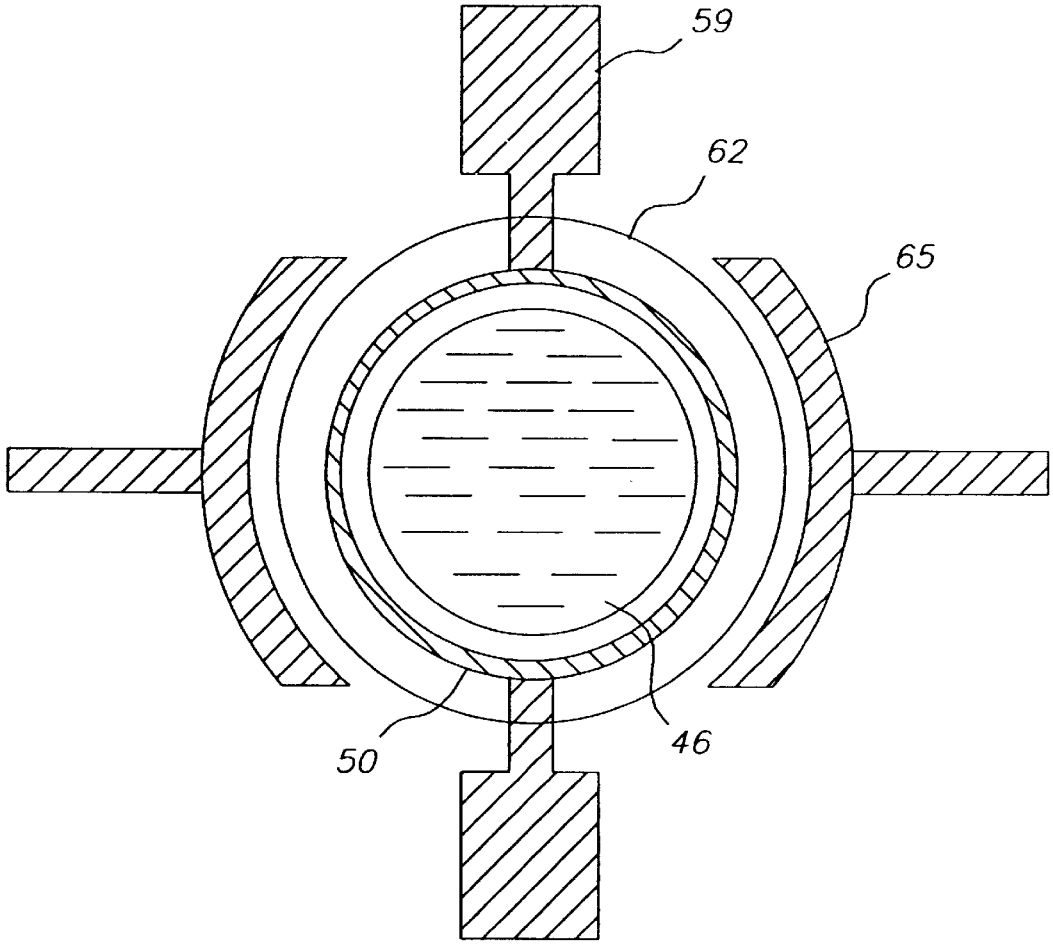

FIG. 3(*a*) is a cross section of the nozzle with binary electrostatic deflection illustrating another embodiment of printhead 16 combined with deflection electrodes 65. Like numbers correspond to like parts in preceding figures. Deflection electrodes 65 are on the surface of a deflection electrode spacing plate 62. FIG. 3(*b*) is a top view of a single nozzle of printhead 16 shown in FIG. 3(*a*). Heater annulus 50 surrounds nozzle bore 46. Power and ground connections 59 from the drive circuitry to heater annulus 50 are shown and are fabricated to lie at about the heater plane below the opening in deflection electrode spacing plate 62. In FIGS. 3(*a*) and 3(*b*), two deflection electrodes 65 are shown on top of deflection electrode spacing plate 62, even though only one is needed. Two deflection electrodes 65 would allow deflection to either side, depending on which electrode was activated. Preferably, the thickness of deflection electrode spacing plate 62 is such that the electrodes are situated above drop break off point 69*b* for the case where electrical energy is supplied to heater (FIG. 2(*b*)) but below drop break off point 69*a* of the case where no electrical energy is supplied (FIG. 2(*a*)).

The deflection electrode spacing plate may be formed from materials such as silicon. Holes may be formed in the plate by etching techniques similar to that used to form nozzle bores 46. Metal electrodes may be patterned on the surface by techniques well known in the art. The plate may be processed separately from printhead 16 and subsequently aligned and bonded with the printhead. Such alignment and bonding techniques are well known in the art. It is recognized that other materials and geometries may be used to produce electric fields capable of deflecting continuous ink jet streams 60.

With stream 60 being deflected, drops 67 may be blocked from reaching recording medium 18 by ink gutter 17. It is recognized that deflection may be achieved by one or more electrodes placed on the surface of the deflection electrode spacing plate 62. With electrical energy applied to heater 50, drops 66 will not be blocked by ink gutter 17. The electrical energy applied to heater 50 may vary with time, allowing individual drops 67 to be blocked by ink gutter 17 as shown in FIG. 2(*a*). In a less preferred, alternate printing scheme, ink gutter 17 may be placed to block undeflected drops 66 so that deflected drops 67 will be allowed to reach recording medium 18.

In the illustrated embodiment of the present invention, the nozzle is of cylindrical form, with heater 50 forming an annulus. The heater is made of polysilicon doped at a level of about thirty ohms/square, although other resistive heater material could be used. The width of heater 50 in this example is between about 0.6 $\mu$m and 0.8 $\mu$m. Heater 50 is separated from substrate 42 by thermal and electrical insulating layers 56 to minimize heat loss to the substrate. The layers in contact with the ink can be passivated with a thin film layer 64 for protection. The printhead surface can be coated with a hydrophobizing layer 68 to prevent accidental spread of the ink across the front of the printhead.

Figure 4A:
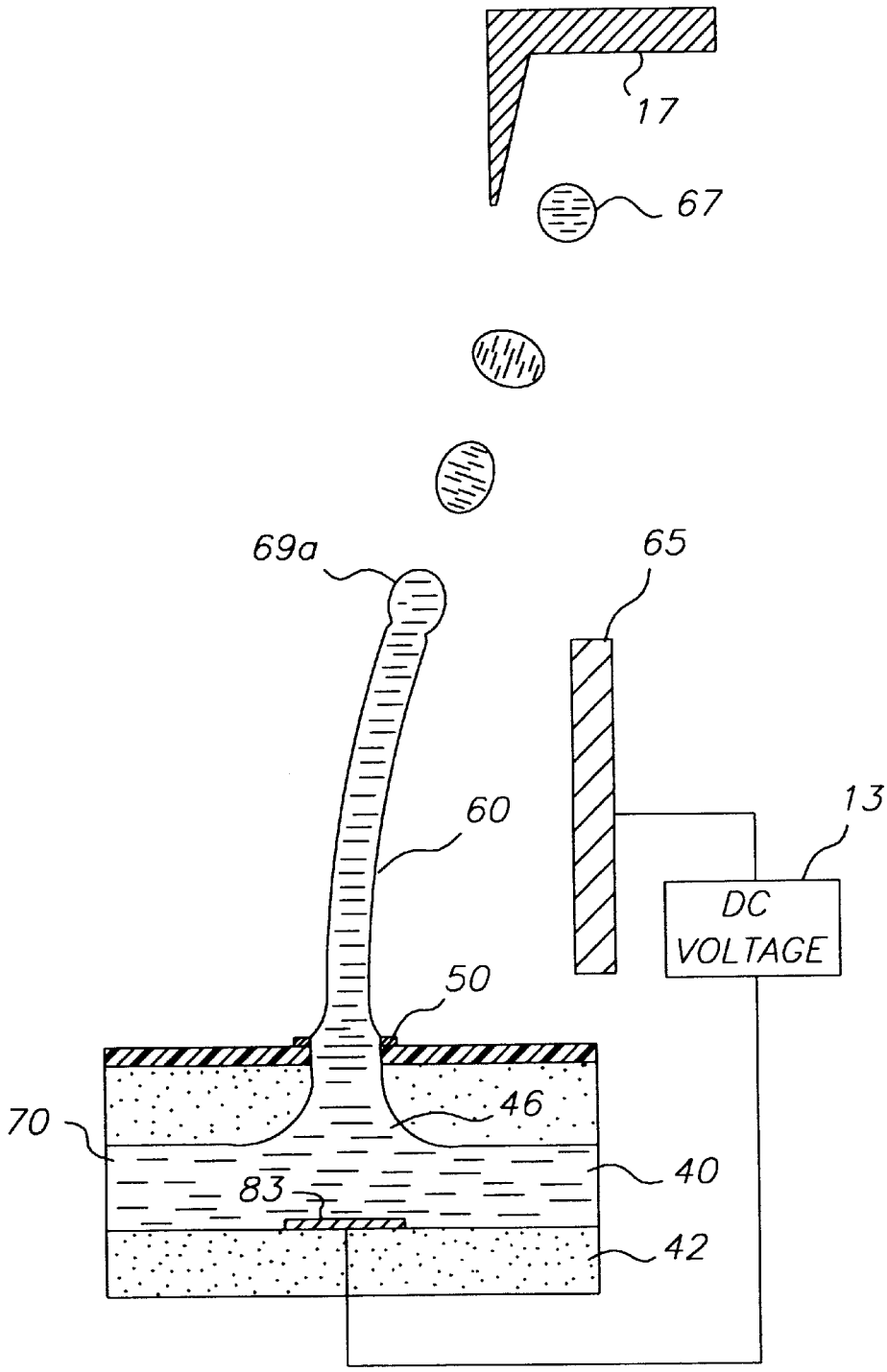
FIG. 4(*a*) illustrates operation of an alternate embodiment of the printhead with the binary electrostatic deflection means without electrical energy supplied to the heater.
Figure 4B:
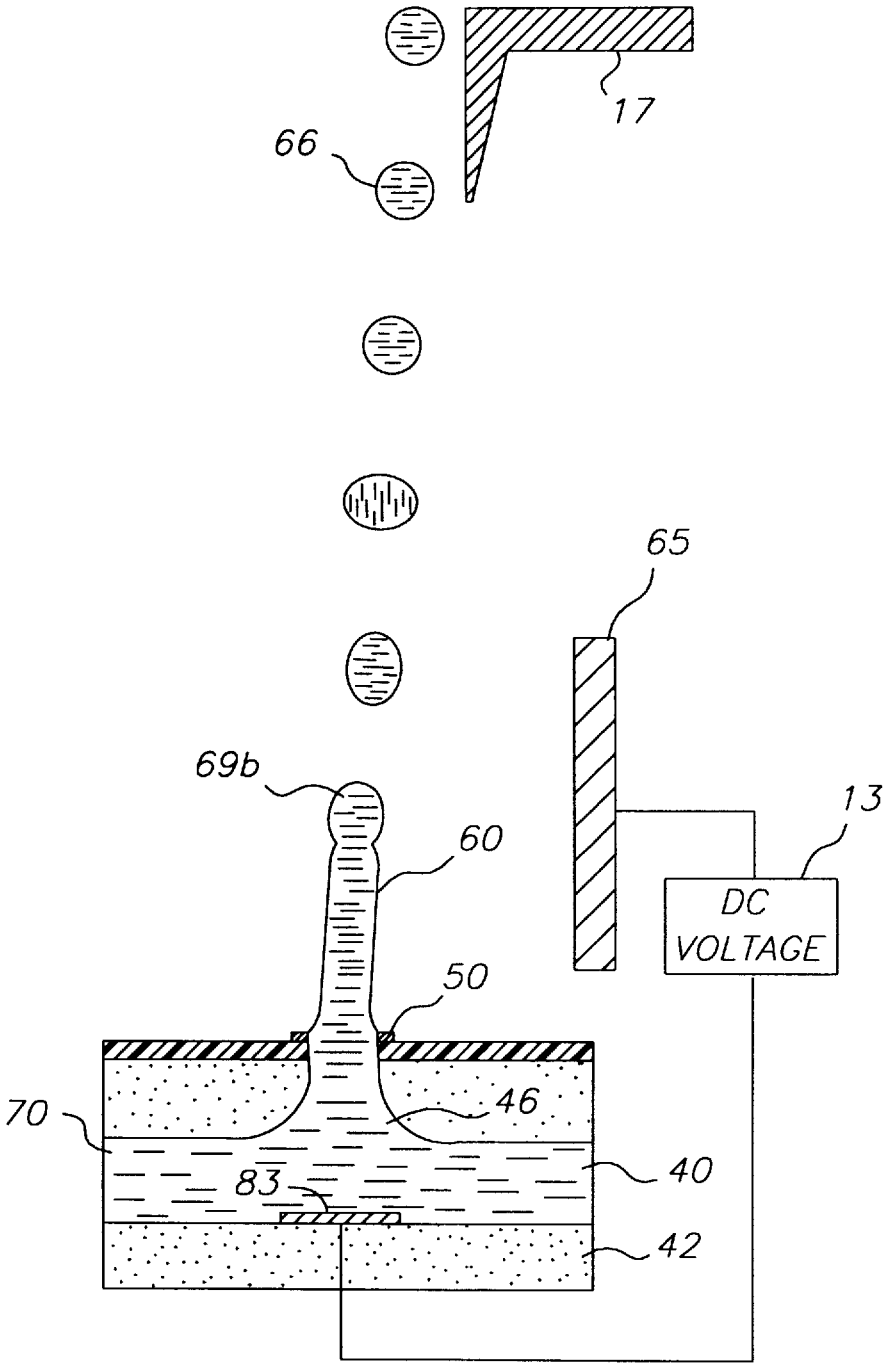

FIGS. 4(*a*) and 4(*b*) illustrate operation of yet another embodiment of the printhead with the binary electrostatic deflection means. Like numbers correspond to like parts in prior figures. A larger deflection electrode 65 is used. In this embodiment, the electrode extends below drop break off point 69*b* for the case where electrical energy is supplied to the heater (FIG. 4(*b*)). It may also extend above drop break off point 69*a* for the case where no electrical energy is supplied (FIG. 4(*a*)). It is preferred that the electrode does not extend above the drop break off point 69*a* for the case where no electrical energy is supplied so that undeflected drops 67 obtain little to no charging. In this embodiment, drop discrimination results from the difference in interaction length of streams 60 with the applied electric field. The force due to the larger interaction length in FIG. 4(*a*) (no electrical energy supplied to the heater) will result in a larger deflection than is obtained for the shorter interaction length (electrical energy supplied to the heater) seen in FIG. 4(*b*).

In this embodiment, undeflected drops 66 will be charged and be deflected a small amount through interaction with the deflection electrode 65. As in the previous embodiment, this deflection is of no consequence as long as there is enough separation between the two states to allow the ink gutter to prevent deflected drops 67 from reaching recording medium 18.

EXPERIMENTAL RESULTS

A print head 16 with 16 μm diameter nozzles was fabricated as described above except for deflection electrode spacing plate 62. In place of deflection electrode spacing plate 62, a metal probe was placed in the vicinity of stream 60 in a manner as described in the preferred embodiment associated with FIGS. 2(*a*) and (*b*). An electric field was produced by applying a potential difference of 700 volts between the probe and ink 70. An ink reservoir and pressure control means was used to control the pressure of stream 60. A fast strobe and a CCD camera were used to freeze the image of the drops in motion. A heater power supply was used to provide a current pulse (electrical energy) to heater 50. The ink reservoir was filled with electrically conductive water and a pressure of 73.7 kPa (10.7 lbs/in$^2$) was applied, forming stream 60 with a drop break off point that was approximately 450 μm above the surface of printhead 16. Due to the presence of the electric field, stream 60 underwent a deflection. When a pulse train of 500 ns pulses at a repetition rate of 80 KHz and a power of approximately 95 mW was applied to heater 50, the drop break off point was reduced to approximately 220 μm above the surface of printhead 16 and the deflection angle was reduced by 1.0 degree.

The invention has been described in detail with particular reference to preferred embodiments thereof, but it will be understood that variations and modifications can be effected within the spirit and scope of the invention.

What is claimed is:

1. Apparatus for controlling ink in a continuous ink jet printer in which a continuous stream of ink is emitted from a nozzle; said apparatus comprising:

an ink stream generator which establishes a continuous flow of ink in a stream;

a droplet generator which causes the stream to break up into a plurality of droplets with an adjustable drop break off position having at least (1) a first drop break off position spaced from the nozzle and (2) a second drop break off position spaced from the first drop break off position, said droplet generator being a heater; and a stream deflector adjacent to the stream between the first drop break off position and the second drop break off position to control the direction of the stream between a print direction and a non-print direction.

2. Apparatus as set forth in claim 1, wherein the ink stream generator comprises:

an ink delivery channel;

a source of ink communicating with the ink delivery channel, wherein the ink is pressurized above atmospheric pressure; and a nozzle bore which opens into the ink delivery channel.

3. Apparatus as set forth in claim 2, wherein the droplet generator heater is adjacent to the nozzle bore.

4. Apparatus as set forth in claim 1, further comprising an ink gutter in the path of ink droplets traveling in said non-print direction.

5. Apparatus as set forth in claim 1, further comprising:

at least one deflection electrode; and a deflection control circuit adapted to apply a constant DC voltage to said deflection electrode to deflect droplets from one of said print and non-print directions to the other of said print and non-print directions.

6. Apparatus as set forth in claim 5, wherein the ink stream generator comprises:

an ink delivery channel;

a source of ink communicating with the ink delivery channel, wherein the ink is pressurized above atmospheric pressure; and a nozzle bore which opens into the ink delivery channel.

7. Apparatus as set forth in claim 5, further comprising an ink gutter in the path of ink droplets traveling in only one of said print and non-print directions.

8. A process for controlling ink in a continuous ink jet printer in which a continuous stream of ink is emitted from a nozzle; said process comprising:

establishing a continuous flow of ink in a stream;

selectively applying heat to the stream such that the stream breaks up into a plurality of droplets with at least (1) a first drop break off position spaced from the nozzle and (2) a second drop break off position spaced from the first drop break off position; and deflecting the ink stream between the first drop break off position and the second drop break off position to thereby control the direction of the stream between a print direction and a non-print direction.

9. The process as set forth in claim 8, wherein the step of establishing a continuous flow of ink in a stream comprises:

providing an ink delivery channel;

providing a source of ink communicating with the ink delivery channel;

pressurizing the ink in the delivery channel above atmospheric pressure; and providing a nozzle bore which opens into the ink delivery channel.

10. The process as set forth in claim 8, further comprising providing an ink gutter in the path of ink droplets traveling in said non-print direction.

11. The process as set forth in claim 8, further comprising:

providing at least one deflection electrode; and applying a constant DC voltage to said deflection electrode an electrical potential of a potential to deflect droplets from one of said print and non-print directions to the other of said print and non-print directions.

12. The process as set forth in claim 11, wherein the step of establishing a continuous flow of ink in a stream comprises:

providing an ink delivery channel;

providing a source of ink communicating with the ink delivery channel;

pressurizing the ink in the delivery channel above atmospheric pressure; and providing a nozzle bore which opens into the ink delivery channel.

13. The process as set forth in claim 11, further comprising providing an ink gutter in the path of ink droplets traveling in said non-print direction.

14. A process for controlling ink in a continuous ink jet printer in which a continuous stream of ink is emitted from a nozzle; said process comprising:

establishing a continuous flow of ink in a stream;

selectively applying heat to the stream such that the stream is caused to break up into a plurality of droplets with at least (1) a first drop break off position spaced from the nozzle and (2) a second drop break off position spaced from the first drop break off position; and deflecting the ink stream between the first drop break off position and the second drop break off position to thereby control the direction of the stream between a print direction and a non-print direction.

* * * * *